US007698820B2

(12) United States Patent
Oh

(10) Patent No.: US 7,698,820 B2
(45) Date of Patent: Apr. 20, 2010

(54) HIGH SPEED LINK TYPE RECIPROCATING ELECTRIC SHAVER

(76) Inventor: Tae-Jun Oh, Bupyeong6-ri, Jingeop-eup, 472-864, Namyangju-shi, Gyeonggi-do (KR)

( * ) Notice: Subject to any disclaimer, the term of this patent is extended or adjusted under 35 U.S.C. 154(b) by 533 days.

(21) Appl. No.: 11/626,165

(22) Filed: Jan. 23, 2007

(65) Prior Publication Data

US 2007/0169350 A1 Jul. 26, 2007

(30) Foreign Application Priority Data

Jan. 23, 2006 (KR) ..... 20-2006-0002058

(51) Int. Cl.
*B26B 19/02* (2006.01)

(52) U.S. Cl. ..... 30/43.91; 30/43; 30/346.51

(58) Field of Classification Search ..... 30/43.7, 30/43.8, 43.9, 346.51, 43.91, 43.92, 43.3, 30/43.4, 43

See application file for complete search history.

(56) References Cited

U.S. PATENT DOCUMENTS 2,309,431 A * 1/1943 Alexay ..... 30/43.91
2,339,677 A * 1/1944 Burns ..... 30/43.91
2,590,452 A * 3/1952 Peterson ..... 30/34.2
3,802,073 A * 4/1974 Braun et al. ..... 30/43.92
4,428,117 A * 1/1984 Horii et al. ..... 30/43.91
6,226,871 B1 * 5/2001 Eichhorn et al. ..... 30/43.92
6,357,118 B1 * 3/2002 Eichhorn et al. ..... 30/43.92
2005/0097751 A1 * 5/2005 Parsonage et al. ..... 30/43.91
2008/0141537 A1 * 6/2008 Oh ..... 30/42

FOREIGN PATENT DOCUMENTS

DE 3140957 * 5/1983

* cited by examiner

*Primary Examiner*—Boyer D. Ashley
*Assistant Examiner*—Laura M. Lee
(74) *Attorney, Agent, or Firm*—Cantor Colburn LLP

(57) ABSTRACT

Disclosed is a high speed link type reciprocating electric shaver in which an outer cutter and an inner cutter reciprocate in the right-to-left direction oppositely to each other so that reciprocating effect can be doubled due to only same vibration speed of a motor. The electric shaver includes an outer cutter to reciprocate, and an inner to reciprocate. The inner cutter is connected to a side of vibrator connected to an eccentric shaft of a motor and reciprocates, and the other side of the reciprocating vibrator is connected to the outer cutter by a connecting linkage such that the outer cutter reciprocates in the direction opposite to that of the inner cutter by fixing a center the connecting linkage to a case.

2 Claims, 7 Drawing Sheets

HIGH SPEED LINK TYPE RECIPROCATING ELECTRIC SHAVER

BACKGROUND OF THE INVENTION

1. Field of the Invention

The present invention relates to an electric shaver in which a cutting blade reciprocates in the transverse direction, and more particularly, to a high speed link type reciprocating electric shaver in which an outer cutter and an inner cutter reciprocate in the right-to-left direction oppositely to each other so that reciprocating effect can be doubled due to only a same vibration speed of a motor.

2. Description of the Related Art

Electric shavers are roughly grouped into a rotary type and a reciprocating type. The rotary type electric shaver includes a circular outer cutter and a circular inner cutter disposed in the outer cutter such that the inner cutter rotates to shave. Meanwhile, the reciprocating type electric shaver transforms the rotating force of a motor into a reciprocating movement to shave.

A conventional reciprocating type electric shaver includes an inner cutter installed to reciprocate within an outer cutter such that hair inserted through holes formed in the outer cutter are cut due to the reciprocating movement of the inner cutter.

The reciprocating movement of the inner cutter is caused by which the rotating force of the motor is transmitted to an eccentric shaft, but the rotation force of the motor is not used effectively.

Thus, since the capacity of the motor installed in the electric shaver has a limit, there is a need for an electric shaver to effectively use the rotating force of the motor and to vibrate the cutters at high speed.

SUMMARY OF THE INVENTION

Therefore, the present invention has been made in view of the above and/or other problems, and it is an aspect of the present invention to provide an electric shaver in which an outer cutter and an inner cutter are simultaneously reciprocated at doubled speed in the opposite directions during the rotation of a motor such that the outer and inner cutter can reciprocate at high speed using a same driving force.

It is another aspect of the present invention to provide an electric shaver driven at high speed to remove hair inserted between an outer cutter and an inner cutter before the hair are withdrawn to improve a cutting efficiency.

In accordance with the present invention, the above and other objects can be accomplished by the provision of a link type reciprocating electric shaver comprising: an outer cutter to reciprocate; and an inner cutter to reciprocate; wherein the inner cutter is connected to a side of a vibrator connected to an eccentric shaft of a motor and reciprocates, and the other side of the reciprocating vibrator is connected to the outer cutter by a connecting linkage such that the outer cutter reciprocates in the direction opposite to that of the inner cutter by fixing a center of the connecting linkage to a case. The case comprises a guide traveling groove formed in an upper end in the horizontal direction, the vibrator comprises a slit into which an eccentric shaft is inserted, two connecting protrusions formed at side edges, fixing holes formed in the connecting protrusions, and a protrusion plate vertically formed at an upper central portion thereof, the inner cutter is fixed to an upper end of an inner cutter frame, the inner cutter frame comprises a locking protrusion formed at a lower central portion and a locking groove formed in the locking protrusion, the outer cutter comprises a guide externally bent and extended, a connecting protrusion eccentrically and downwardly extended from a side thereof, and a fixing hole formed in the connecting protrusion, and the connecting linkage includes a center hole formed at the central portion thereof, and a vibrator fixing hole and an outer cutter fixing hole which are respectively formed at lateral sides thereof such that the center hole is fixed to a side of the case and the lateral sides are fixed to the vibrator and the outer cutter, respectively.

BRIEF DESCRIPTION OF THE DRAWINGS

These and/or other objects and advantages of the present invention will become apparent and more readily appreciated from the following description of the embodiments, taken in conjunction with the accompanying drawings, in which.

DESCRIPTION OF THE PREFERRED EMBODIMENTS

Hereinafter, an apparatus according to embodiments of the present invention will be described in detail with reference to the accompanying drawings.

Terms and notations used in the specification and the claims are not limited to the conventional or dictionary meanings, but understood by meanings and concepts that are suitable for the present invention, based on the principle that an inventor(s) can define the concepts of terms and notations for the best description of the invention of the inventor(s).

Figure 1:
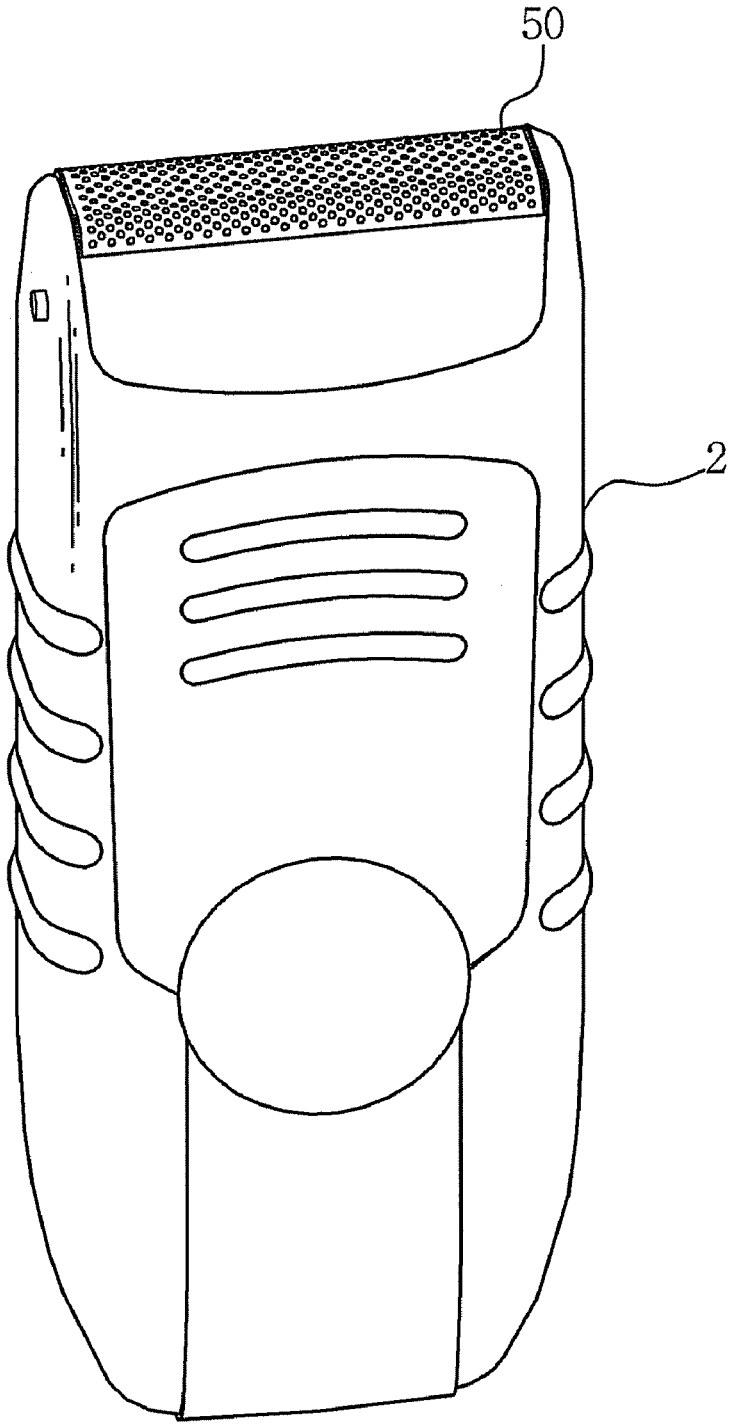
FIG. 1 is a perspective view illustrating a high-speed link type reciprocating electric shaver according to the present invention.
Figure 2:
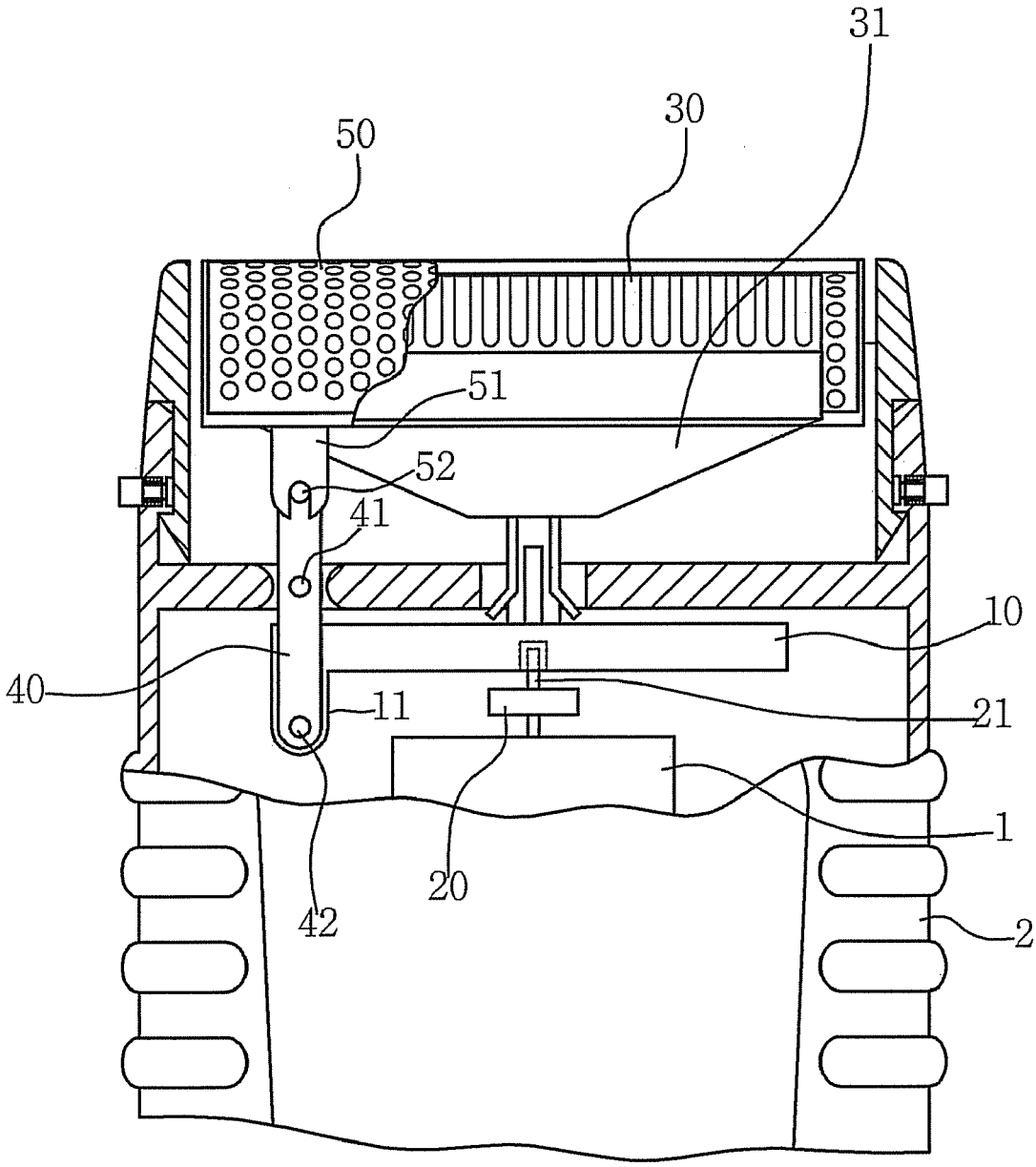
FIG. 2 is a partially cutaway view illustrating the high speed link type reciprocating electric shaver according to the present invention.
Figure 3:
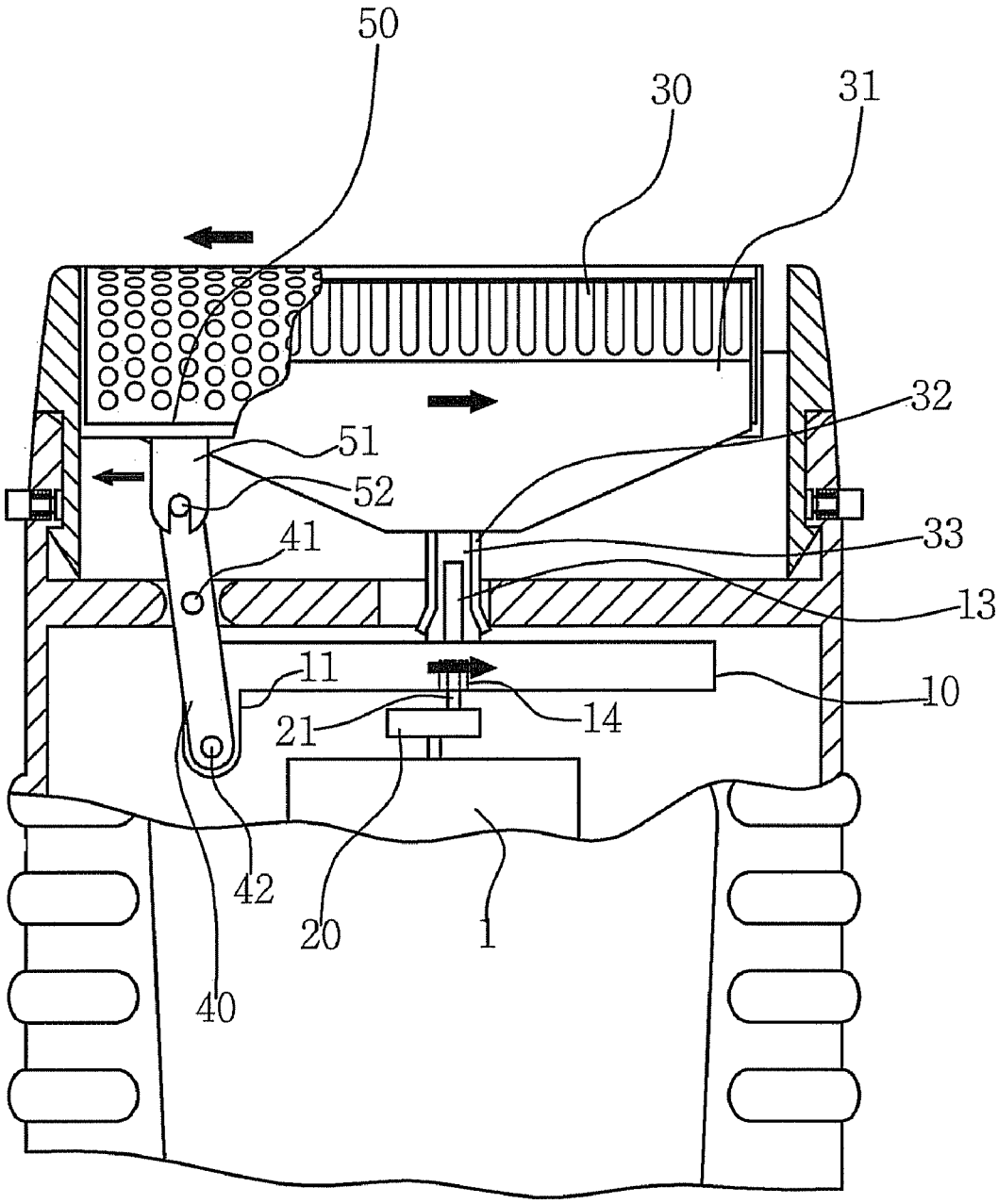
FIG. 3 is a partially cutaway view illustrating operation of the high speed link type reciprocating electric shaver according to the present invention.
Figure 4:
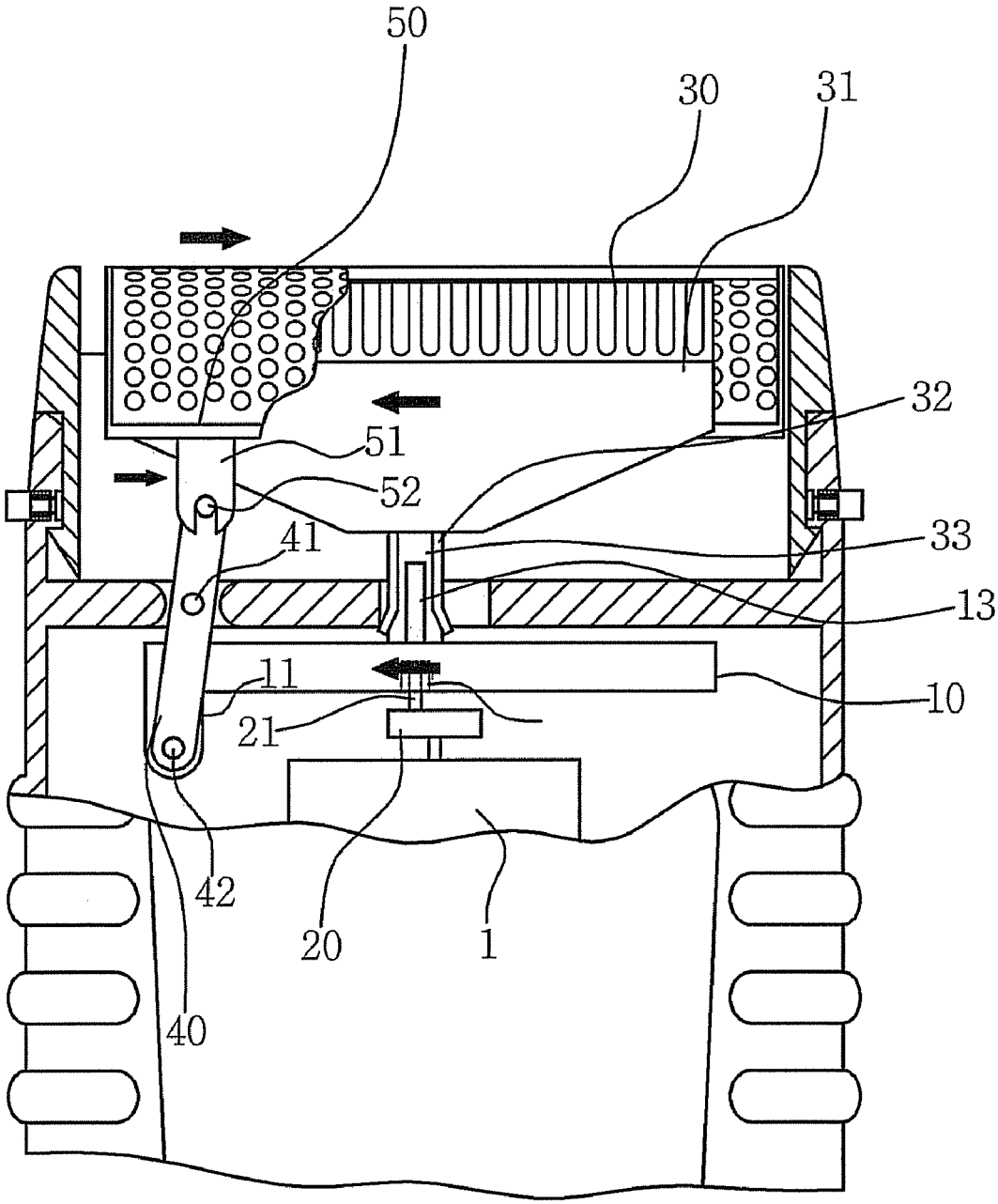
FIG. 4 is a partially cutaway view illustrating operation of the high speed link type reciprocating electric shaver according to the present invention.

FIG. 1 is a perspective view illustrating a high-speed link type reciprocating electric shaver according to the present invention, FIG. 2 is a partially cutaway view illustrating the high speed link type reciprocating electric shaver according to the present invention, FIG. 3 is a partially cutaway view illustrating operation of the high speed link type reciprocating electric shaver according to the present invention, and FIG. 4 is a partially cutaway view illustrating operation of the high speed link type reciprocating electric shaver according to the present invention.

Figure 5:
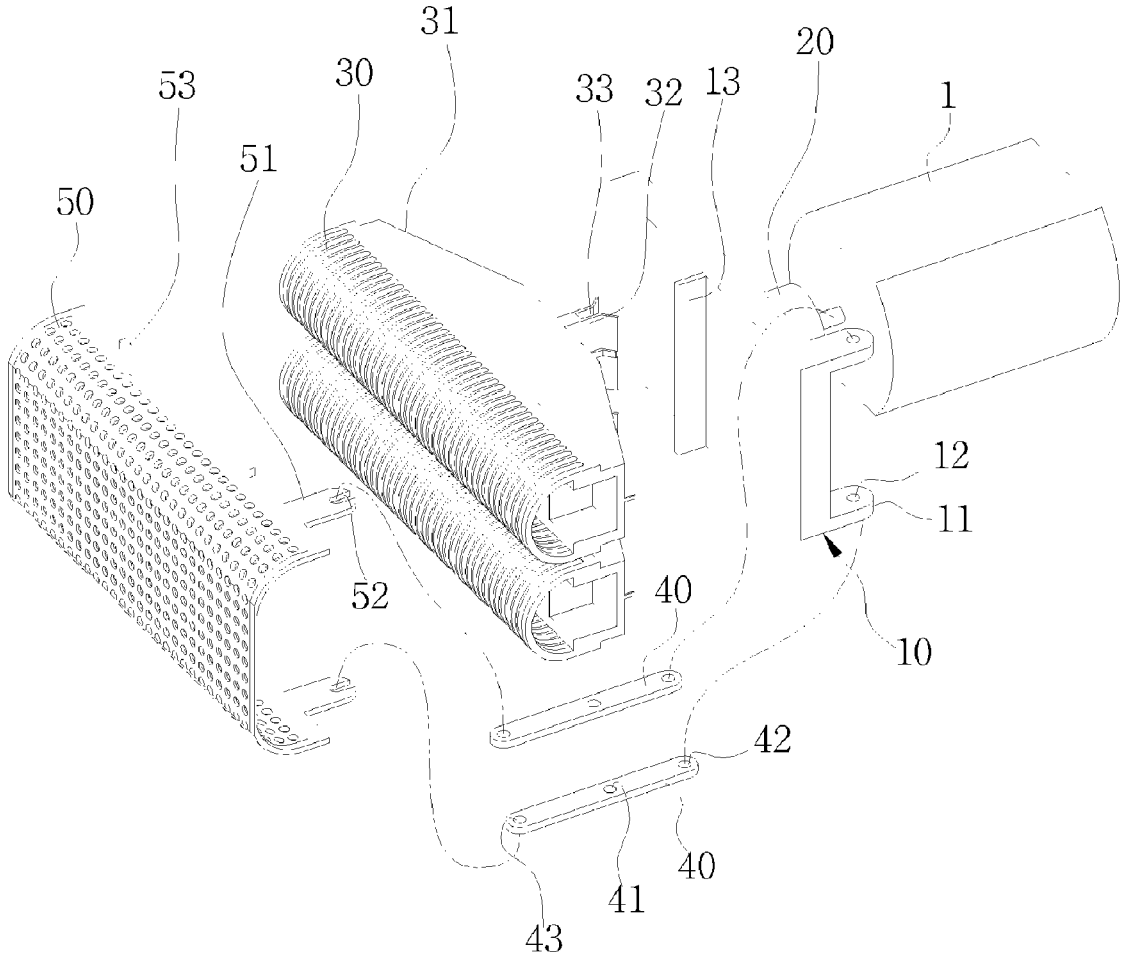
FIG. 5 is an exploded perspective view illustrating the high speed link type reciprocating electric shaver according to the present invention.

FIG. 5 is an exploded perspective view illustrating the high speed link type reciprocating electric shaver according to the present invention, and is the best view of illustrating the structure of the link type reciprocating electric shaver according to the present invention.

Figure 6:
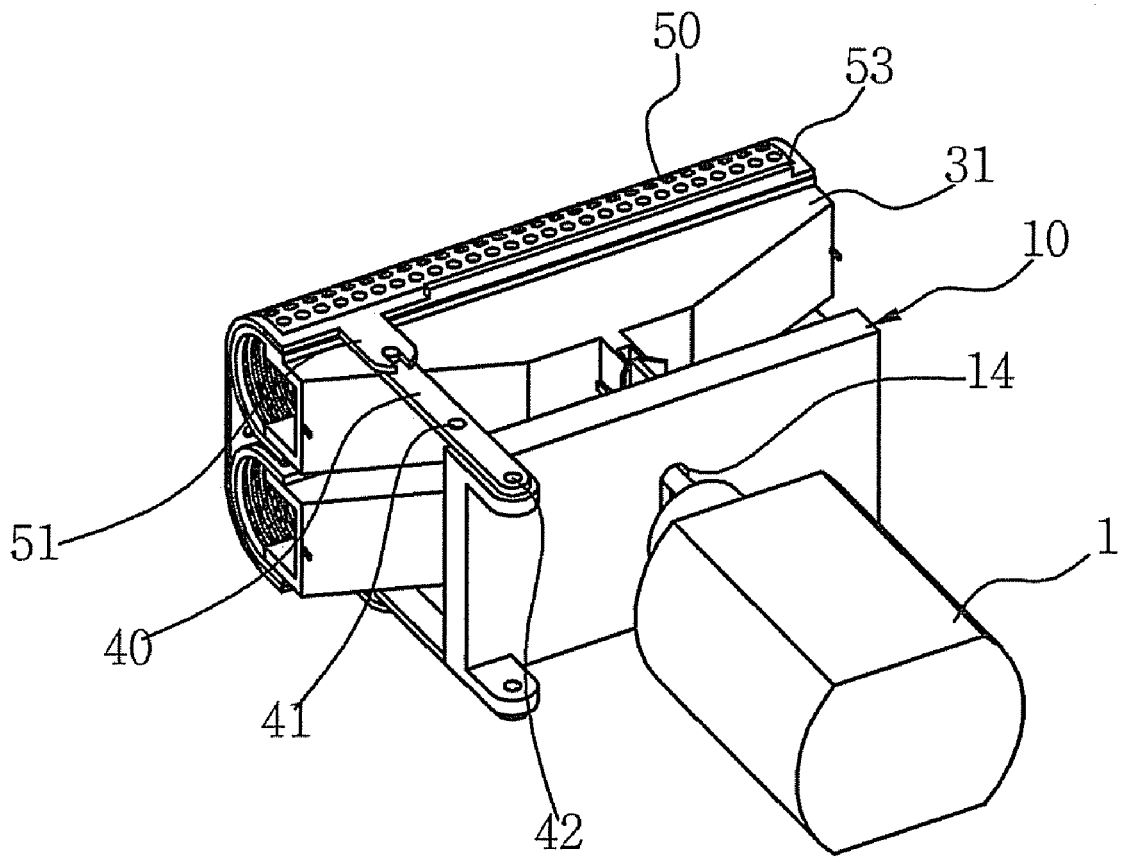
FIG. 6 is a perspective view illustrating a main part of the high-speed link type reciprocating electric shaver according to the present invention.
Figure 7:
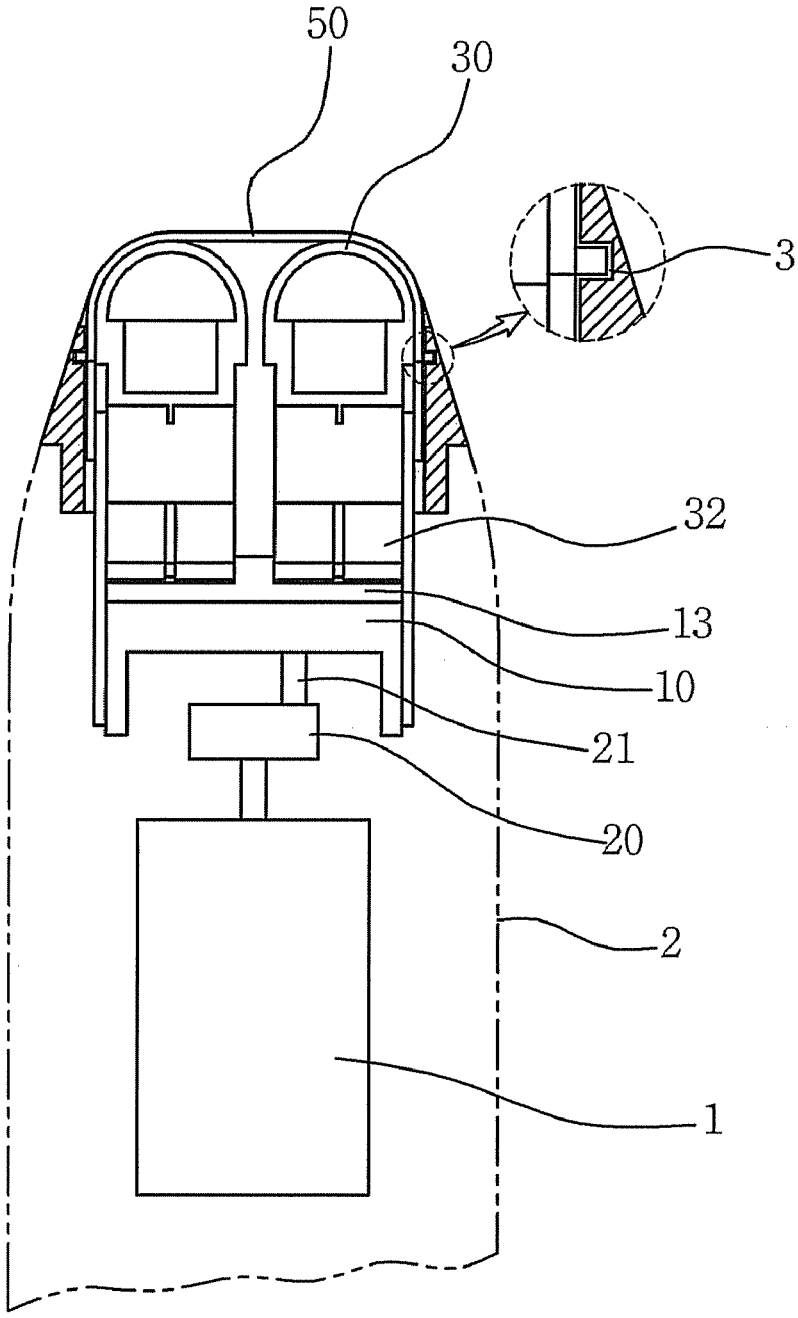
FIG. 7 is a longitudinal sectional view illustrating the high-speed link type reciprocating electric shaver according to the present invention.

FIG. 6 is a perspective view illustrating a main part of the high-speed link type reciprocating electric shaver according to the present invention, and FIG. 7 is a longitudinal sectional view illustrating the high-speed link type reciprocating electric shaver according to the present invention.

The reciprocating electric shaver according to the present invention includes an outer cutter and an inner cutter to drive the reciprocating outer and inner cutter at high speed. The reciprocating shaver further includes a vibrator 10 connected to an eccentric cam 20 of a motor 1 to vibrate, an inner cutter frame 31 into which a protrusion formed at a central portion of the vibrator 10 is inserted to transmit a reciprocating movement, and an outer cutter 50 connected to linkages 40 to be reciprocated due to the movements of the linkages 40.

Specifically, an inner cutter 30 is connected to a protrusion plate 13 of the vibrator 10, the vibrator 10 is reciprocally connected to an eccentric shaft 21 of the motor 1, and the linkages 40 are connected to connecting protrusions of the reciprocating vibrator 10 and the outer cutter 50 such that the outer cutter 50 moves in the direction opposite to the direction of the inner cutter 30 and the centers of the linkages 40 are fixed to a case 2.

The case 2 has guide traveling grooves 3 formed in upper inner side thereof to guide the outer cutter to reciprocate as described later.

The vibrator 10 has a slit 14, into which the eccentric shaft 21 is inserted, formed in the lower side thereof, and two connecting protrusions 11 formed at side edges thereof. Fixing holes 12 are formed in the connection protrusions 11 of the vibrator 10 such that ends of the connecting linkages 40 are connected to rotate, and a protrusion plate 13 is vertically formed in the upper central portion of the vibrator 10. The protrusion plate 13 is vertical to the traveling direction of the vibrator 10.

At least one inner cutter 30 is fixed to an upper end of the inner cutter frame 31 and a locking protrusion 32 is formed in the lower central portion of the inner cutter frame 31. A locking groove 33 is formed in the locking protrusion 32 such that the protrusion plate 13 of the vibrator 10 is inserted into the locking groove 33 to transmit the reciprocating movement. At this time, sides of the locking groove 33 are separated such that the insertion is easily carried out.

The outer cutter 50 includes both ends whose parts are bent and extend externally to form guide 53 and connecting protrusions 51 eccentrically and downwardly extended from a side thereof. The connecting protrusions 51 of the outer cutter 50 are formed with fixing holes 52 and the fixing holes 52 are communicated with outer cutter fixing holes 43 of the connecting linkages 40 such that the connecting protrusions 51 are fixed to rotate.

Each of the connecting linkages 40 has a center hole 41 formed at the central portion thereof, and a vibrator fixing hole 42 and an outer cutter fixing hole 43 which are respectively formed at lateral sides thereof such that the center hole 41 is fixed to a side of the case 2 and the lateral sides are fixed to the vibrator 10 and the outer cutter 50, respectively.

When the motor 1 rotates, the eccentric cam 20 connected to a rotating shaft of the motor 1 rotates and the eccentric cam 21 rotates due to the rotation of the eccentric cam 20.

The vibrator 10 into which the eccentric shaft 21 is inserted reciprocates due to the rotation of the eccentric shaft 21.

The inner cutter frame 31 directly connected to the reciprocating vibrator 10 reciprocates in the same direction as that of the vibrator 10, and the outer cutter 50 fixed to the vibrator 10 by the connecting linkages 40 reciprocates about the center holes 41 of the connecting linkages 40 in the direction opposite to the movement direction of the vibrator 10.

Thus, due to the rotation of a same motor, the outer cutter 50 and the inner cutter 30 travel in the opposite directions to make a doubled speed.

As described above, according to the electric shaver of the present invention, the vibrator reciprocates due to the rotating force of the motor to make the outer cutter and the inner cutter reciprocated in the opposite directions so that the cutters reciprocated at the doubled speed using the rotating force of the same motor.

Therefore, since a high-speed movement can be realized by a small driving force, a motor with a small capacity can exhibit the same effect so that a small-size electric shaver can be realized.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A link type reciprocating electric shaver comprising:

an outer cutter which reciprocates;

an inner cutter which reciprocates; and a vibrator comprising:

a slit into which an eccentric shaft is inserted;

two connecting protrusions of the vibrator disposed at a side edge of the vibrator;

fixing holes formed in the connecting protrusions; and a protrusion plate vertically disposed at an upper central portion of the vibrator, wherein the inner cutter is connected to the protrusion plate of the vibrator, which is reciprocally connected to an eccentric shaft of a motor, each of the connecting protrusions of the vibrator is connected to the outer cutter by a connecting linkage, and the outer cutter reciprocates in a direction opposite to a direction of the inner cutter by fixing a center of the connecting linkage to a case.

2. The link type reciprocating electric shaver according to claim 1, wherein an upper end of the case comprises a guide traveling groove disposed in a horizontal direction, the inner cutter is fixed to an upper end of an inner cutter frame, the inner cutter frame comprises a locking protrusion formed at a lower central portion and a locking groove formed in the locking protrusion, the outer cutter comprises a guide externally bent and extended, a connecting protrusion eccentrically and downwardly extended from a side thereof, and a fixing hole formed in the connecting protrusion, and the connecting linkage includes a center hole formed at the central portion thereof, and a vibrator fixing hole and an outer cutter fixing hole which are respectively formed at lateral sides thereof such that the center hole is fixed to a side of the case and the lateral sides are fixed to the vibrator and the outer cutter, respectively.

* * * * *